US010234187B2

(12) United States Patent
Rieder

(10) Patent No.: US 10,234,187 B2
(45) Date of Patent: Mar. 19, 2019

(54) FLUID-JET EMITTING DEVICE

(71) Applicant: TECHNOALPIN HOLDING S.P.A., Bolzano (IT)

(72) Inventor: Walter Rieder, Cornedo all'Isarco (IT)

(73) Assignee: TECHNOALPIN HOLDING S.P.A., Bolzano (IT)

( * ) Notice: Subject to any disclaimer, the term of this patent is extended or adjusted under 35 U.S.C. 154(b) by 19 days.

(21) Appl. No.: 15/320,665

(22) PCT Filed: Apr. 28, 2015

(86) PCT No.: PCT/IB2015/053070
§ 371 (c)(1),
(2) Date: Dec. 20, 2016

(87) PCT Pub. No.: WO2015/198163
PCT Pub. Date: Dec. 30, 2015

(65) Prior Publication Data

US 2017/0153053 A1 Jun. 1, 2017

(30) Foreign Application Priority Data

Jun. 26, 2014 (IT) ..... VR2014A0175

(51) Int. Cl.

| | |
|---|---|
| ***B05B 7/00*** | (2006.01) |
| ***F25C 3/04*** | (2006.01) |
| ***B05B 7/08*** | (2006.01) |
| ***B05B 7/16*** | (2006.01) |

(52) U.S. Cl.
CPC ..... *F25C 3/04* (2013.01); *B05B 7/0853* (2013.01); *B05B 7/1606* (2013.01); *F25C 2303/046* (2013.01); *F25C 2303/0481* (2013.01)

(58) Field of Classification Search
CPC ..... B05B 7/061; B05B 7/0075; E21F 5/02; C02F 1/12
USPC ..... 239/8, 424, 424.5, 2.2, 14.2
See application file for complete search history.

(56) References Cited

U.S. PATENT DOCUMENTS 3,945,567 A * 3/1976 Rambach ..... F04F 5/466 239/132.5
5,509,790 A 4/1996 Schuderi et al.

FOREIGN PATENT DOCUMENTS

DE 41 31 857 A1 4/1993
DE 4131857 A1 * 4/1993 ..... F25C 3/04
DE 195 23 052 A1 12/1996

(Continued)

*Primary Examiner* — Viet Le
(74) *Attorney, Agent, or Firm* — Pearne & Gordon LLP

(57) ABSTRACT

Described is a device (1) for emitting a jet of fluid comprising a tubular member (2) having at least one air inlet opening (4) and one air outlet opening (5). Moreover, the device (1) comprises blowing means (6), located inside the tubular member (2) for sucking air from the inlet opening (4) and generating a flow of air coming out of the outlet opening (5); the blowing means (6) comprising a drive unit (7) and an air movement member (8) connected to the drive unit (7). The device (1) also comprises an apparatus (11) having at least one fluid delivery nozzle (12) and an air compression structure (13) connected to the delivery nozzle (12). More specifically, the drive unit (7) is connected to the air compression structure (13) to set it in action and they are both located inside a container (16).

16 Claims, 2 Drawing Sheets

(56) References Cited

FOREIGN PATENT DOCUMENTS

| | | | | |
|---|---|---|---|---|
| DE | 19523052 | A1 * | 12/1996 | ..... F25C 3/04 |
| WO | 2011/094975 | A1 | 8/2011 | |

* cited by examiner

FLUID-JET EMITTING DEVICE

TECHNICAL FIELD

This invention relates to a device for discharging a jet of fluid. Preferably, this invention relates to the field of devices for generating artificial snow (commonly known by the term "snow cannons").

However, this invention may also relate to other sectors which comprise emitting a jet of fluid, for example, for reducing harmful substances, for reducing dust, for cooling a certain area or volume of air, for mitigating the effect of an explosion or for other uses not expressly described herein.

For simplicity of description, reference will be made below to the preferred embodiment wherein the device for emitting a jet of fluid is a snow cannon.

BACKGROUND ART

According to the prior art, a snow cannon comprises a tubular member having an inlet opening and an outlet opening. A transit zone is defined inside the tubular member which is in fluid communication with the outside through the inlet opening and the outlet opening.

Moreover, blowing means are usually mounted inside the tubular member for sucking air from the inlet opening and generating an air flow out through the outlet opening.

More specifically, the blowing means comprise a motor and a fan connected to the motor. Moreover, the snow cannon comprises an apparatus located around the outlet opening of the cannon for delivering fluid towards the flow of air.

This apparatus comprises a plurality of fluid delivery nozzles and a air compressor which is motor-driven and connected to the delivery nozzles for mixing the fluid with the compressed air. More in detail, these delivery nozzles are nucleator nozzles. As is known in the sector of snow cannons, the nucleator nozzles generate a mixture of drops of water and compressed air which, in contact with the cold outside air, undergo an expanding and freezing process.

Thus, the snow cannon comprises two electric motors: a motor for operating the fan of the blowing means and the motor of the compressor. Alternatively, each cannon is fed by a centralised system configured for bringing the compressed air to each cannon (thus each cannon does not need the motor for the compressor). In that case, there is a single motor-driven air compressor located downstream of the cannons and connected to each of them by suitable compressed air distribution ducts. However, this centralised air distribution system is complicated to make (it is necessary to move the ducts to each cannon) and, very expensive.

In order to optimise the electricity consumption, as described in patent application DE4131857, there are prior art air solutions wherein the compressor is driven by the motor of the fan and is located inside the cannon near the fan (so there is therefore a single electric motor). In other words, the compressor is located inside the tubular member alongside the motor of the fan and is mechanically connected to the latter by a connecting shaft.

However, this prior art technique has several drawbacks.

The main drawback is linked to the fact that the compressor generates heat (on account of the physical process of compressing air) which is dispersed inside the tubular member and which, at least partly, heats the flow of air designed to generate the snow flakes.

Consequently, that heat generated by the compressor disturbs the thermal equilibrium relating to the air flow. In addition, based on this prior art technique, it is not possible to control the emission of the heat inside the tubular member in such a way as to disturb as little as possible the internal thermal equilibrium.

AIM OF THE INVENTION

In this situation the aim of this invention is to provide a device for emitting a jet of fluid which overcomes the aforementioned drawbacks.

In particular, the aim of this invention is to provide a device for emitting a jet of fluid having the air compressor driven by the motor of the fan which reduces the heating of the air compression during use.

Another aim of this invention to provide a device for emitting a jet of fluid which having the air compressor driven by the motor of the fan reduces the thermal disturbances on the flow of air.

The aims indicated are substantially achieved by a device for emitting a jet of fluid as described in the appended claims.

BRIEF DESCRIPTION OF DRAWINGS

Further characteristic features and advantages of this invention will emerge more clearly from the detailed description of several preferred, but not exclusive embodiments of a device for emitting a jet of fluid illustrated in the accompanying drawings, in which.

DESCRIPTION OF A PREFERRED EMBODIMENT OF THE INVENTION

Figure 1:
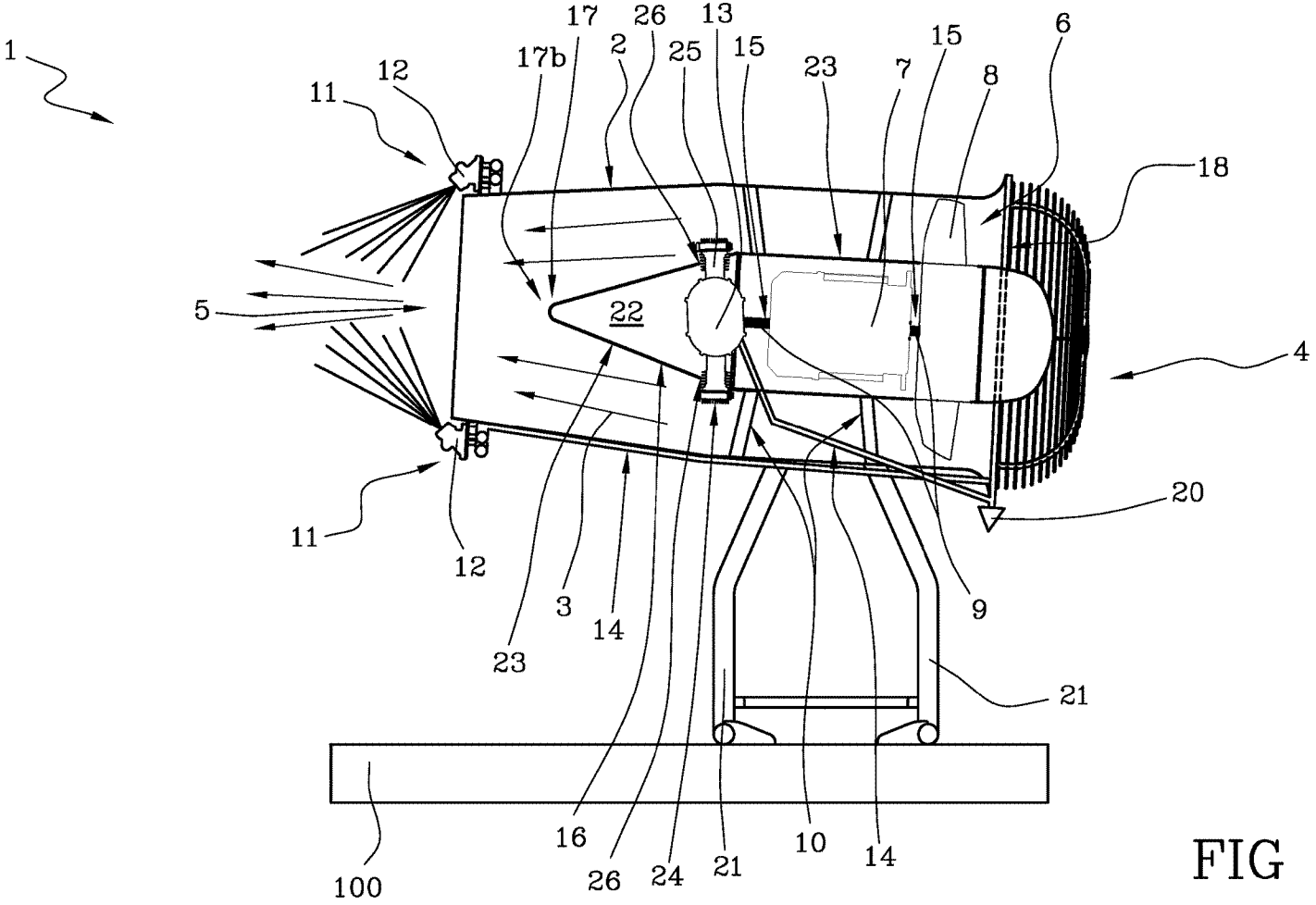
FIG. 1 shows a side view, partly transparent, of a fluid-jet emitting device according to this invention.

With reference to the accompanying drawings, the numeral 1 denotes in its entirety a device 1 for emitting a jet of fluid according to this invention. As mentioned above, in the preferred embodiment the device 1 for emitting a jet of fluid is a snow cannon.

Preferably, the device 1 comprises a tubular member 2 extending along a respective main direction of extension 3 between a relative air inlet opening 4, and a relative air outlet opening 5.

In addition, the device 1 comprises blowing means 6, located inside the tubular member 2 to suck air from the inlet opening 4 and to generate an air flow out through the outlet opening 5. In other words, the blowing means 6 generate inside the tubular member 2 a flow of air propagating from the inlet opening 4 to the outlet opening 5 and from the latter towards the outside environment.

More specifically, the blowing means 6 comprising a drive unit 7 and an air movement member 8 connected to the drive unit 7. Preferably, the drive unit 7 is an electric motor and the air movement member 8 is a fan. More in detail, the fan rotates according to an axis substantially parallel to the main direction of extension 3 of the tubular member 2.

In other words, the drive unit 7 and the air movement member 8 are located along the main direction of extension 3 of the tubular member 2. Preferably, the drive unit 7 and the air movement member 8 are aligned along the main direction of extension 3 of the tubular member 2.

In the preferred embodiment illustrated in the accompanying drawings, the air movement member 8 is located closer to the inlet opening 4 than the drive unit 7. However, in a alternative embodiment, not illustrated in the accompanying drawings, the drive unit 7 is located closer to the inlet opening 4 than the air movement member 8. In a variant of this alternative embodiment, the drive unit 7 is located on the outside of the inlet opening 4.

In any case, the air movement member 8 is preferably connected to the drive unit 7 by means of a rotary shaft 9.

Moreover, the device 1 comprises an internal supporting structure 10 connected between an inner surface of the tubular member 2 and the drive unit 7 to support it inside the tubular member 2.

In addition, the device 1 comprises an apparatus 11 for delivering the fluid towards the air flow. Preferably, the apparatus 11 is located at the outlet opening 5. In particular, the apparatus 11 comprises at least one fluid delivery nozzle 12. Preferably, the apparatus 11 comprises a plurality of fluid delivery nozzles 12 located around the outlet opening 5. More specifically, in the preferred case of the use of the device 1 as a snow cannon, the apparatus 11 comprises nucleator delivery nozzles 12 and nebulizing delivery nozzles 12.

More in detail, the delivery nozzles 12 may be located outside the tubular member 2 (connected to the outer surface of the tubular member 2) or inside the tubular member 2. Alternatively, some delivery nozzles 12 are located outside the tubular member 2 whilst other delivery nozzles 12 are located inside the tubular member 2. Preferably, the nozzles of dispensing nucleator delivery nozzles 12 are located inside the tubular member 2 (as explained in more detail below) whilst the nebulizing delivery nozzles 12 are located at the outlet opening 5.

Moreover, the apparatus 11 comprises an air compression structure 13 connected to the delivery nozzle for mixing the fluid with the compressed air. In detail, the fluid delivery apparatus 11 comprises a duct 14 for carrying the compressed air from the air compression structure 13 to the delivery nozzle 12. Preferably, the air compression structure 13 is connected to a plurality of delivery nozzles 12. Even more preferably, the air compression structure 13 is connected to the nucleator delivery nozzles 12.

It should be noted that the compression structure 13 is not in itself motorised. In other words, the compression structure 13 does not comprise a motor. In yet other words, the compression structure 13 comprises the set of non-motorised means designed to compress the air. For example, the compression structure 13 may be of a volumetric type, where the compression is given by predetermined mechanical movements, of a dynamic type, where the compression is obtained by the speed which it is possible to impart on the air, or of another type not expressly mentioned herein.

More specifically, the drive unit 7 is mechanically connected to the air compression structure 13 for operating it in such a way that the air movement member 8 and the air compression structure 13 are driven by the drive unit 7. In other words, the drive unit 7 moves the air compression structure 13 and the air movement member 8. In yet other words, the air movement member 8 and the air compression structure 13 are driven by the same drive unit 7. As already mentioned, the drive unit 7 comprises a single electric motor.

It should also be noted that the air compression structure 13 is located inside the tubular member 2 at the drive unit 7. More specifically, the blowing means 6 comprise drive transmission means 15 connected between the drive unit 7 and the air movement member 8 and the air compression structure 13 for operating them. More in detail, that the drive transmission means 15 comprise the rotary shaft 9 moved by the drive unit 7 and connected to the air movement member 8 and to the air compression structure 13.

In other words, the drive unit 7, the air movement member 8 and the air compression structure 13 are located along the rotation shaft 9. In yet other words, the drive unit 7, the air movement member 8 and the air compression structure 13 are aligned along the main direction of extension 3 of the tubular member 2.

In that way, advantageously, it is possible to use a single electric motor for moving both the compression structure 13 and the air movement member 8.

More specifically, the blowing means 6 comprise a container 16 located inside the tubular member 2. The container 16 is supported by the internal supporting structure 10 located between the inner surface of the tubular member 2 and the container 16.

As mentioned above, in the preferred embodiment the nucleator delivery nozzles 12 located inside the tubular member 2 are connected to the container 16 (preferably on the tapered part described below) and face towards the flow of air in movement towards the outlet opening 5.

According to this invention, the container 16 defines an internal cavity 22 inside of which are located at least part of the drive unit 7 and at least part of the compression structure 13.

Advantageously, the container 16 has an outside surface 23 shaped to guide the flow of air towards the outlet opening 5. More specifically, the outside surface 23 has an outer shape which is at least partly substantially tapered in a direction from the air inlet opening 4 to the air outlet opening 5, thus defining a diffuser between the outside surface 23 and the tubular member 2.

In that way, the container 16 facilitates the passage of air in such a way as to favour the sliding of the air flow preventing the air from directly striking the drive unit 7 and the the compression structure 13 (as, on the other hand, is shown in prior art patent document DE4131857).

Preferably, the outer shape of the outer surface 23 of the container 16 is ogival.

More in detail, the part of the tubular member 2 closest to the outlet opening 5 is tapered in the direction of the outlet opening 5. Advantageously, this shape of the tubular member 2 follows the external shape of the container 16 in such a way that the volume of the air flow does not expand before reaching the outlet opening 5 of the tubular member 2.

It should be noted that at least part of the compression structure 13 is directly exposed to the air flow generated by the blowing means 6 so as to cool the compression structure 13. In other words, the container 16 comprises means of directing the air flow generated by the blowing means 6 towards the compression structure 13.

In a first embodiment illustrated in FIG. 1, the means of directing the air flow comprise at least a through opening 26 between the internal cavity 22 and the tubular member 2 through which is inserted the protruding portion in such a way that it protrudes towards the inside of the tubular member 2. More specifically, the compression structure 13 has a portion 24 which protrudes from the container 16 towards the inside of the tubular member 2 to be directly exposed to the air flow generated by the blowing means 6 so as to cool the compression structure 13. Even more specifically, the protruding portion is inserted through the through opening 26 of the container in such a way as to protrude towards the tubular member.

Preferably, the compression structure 13 comprises at least one head internally defining a respective compression chamber where the air is compressed. At least part of the head 25 defines the protruding portion 24 of the compression structure 3.

In other words, the head 25 is inserted in the through opening 26 in such a way that it protrudes towards the inside of the tubular member 2 to be exposed to the air flow and therefore cooled by the latter during use.

In the embodiment of FIG. 1 the compression structure 13 comprises two heads 25 each of which is inserted through a respective opening. In other words, in FIG. 1 the container 16 has two through openings through which are respectively inserted the heads 25.

Alternatively, the compression structure 13 could comprise more heads 25 and, therefore, the container might have more through openings 26.

In any case, the number of through openings 26 made on the container 16 is equal to the number of protruding portions 24 (heads 25) which are exposed to the air flow.

Figure 2:
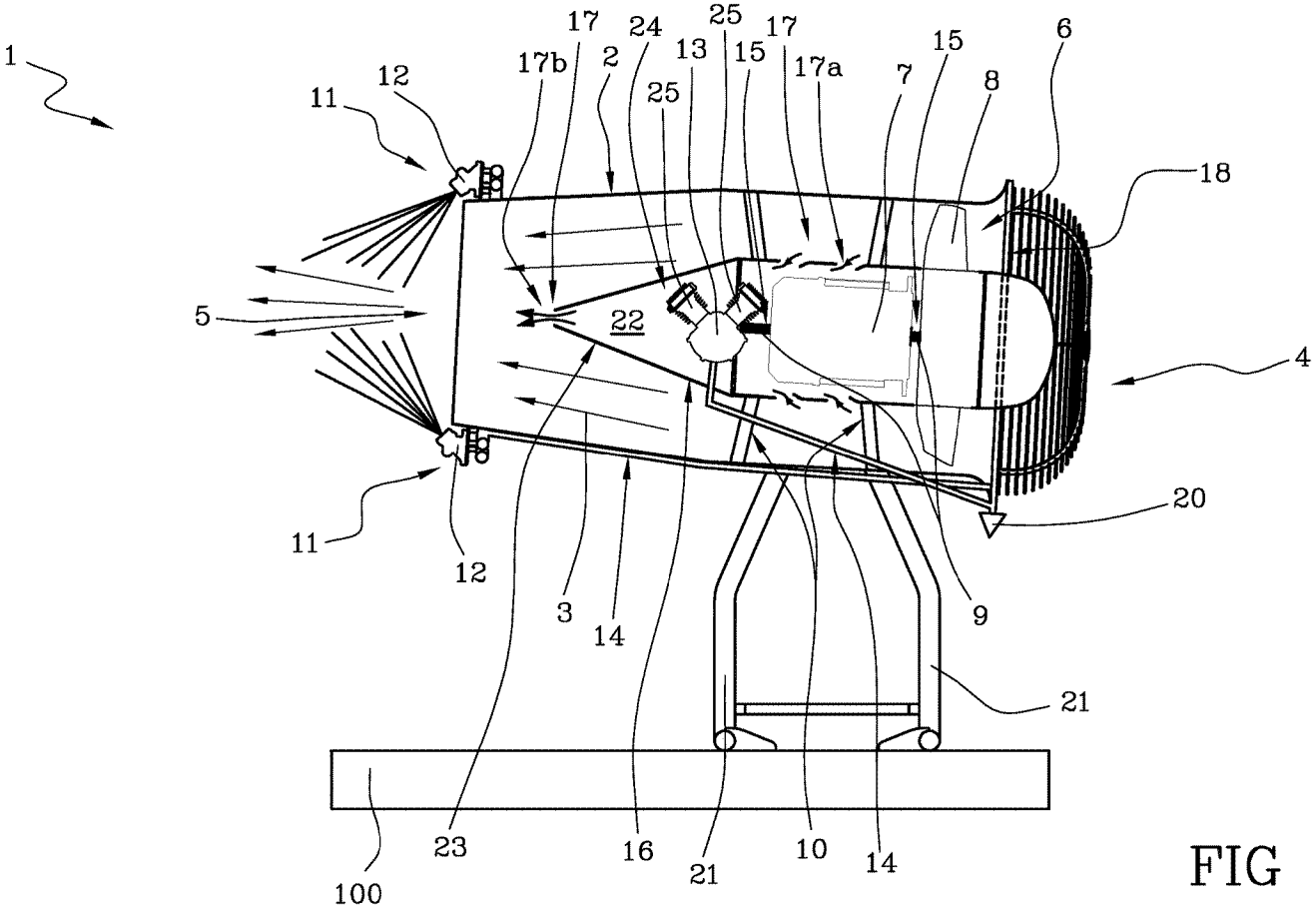
FIG. 2 shows side view, partly transparent, of an alternative embodiment of the device of FIG. 1.

In a second embodiment illustrated in FIG. 2, the means of directing the air flow comprise at least one through hole 17 for the circulation of part of the air flow towards the inside of the container 16 in such a way as to cool, during use, the compression structure 13. In other words, part of the flow of air generated by the blowing means 6 enters the container 16 through the through hole 17 for cooling the compression structure 13.

Preferably, the container 16 has a plurality of through holes 17 in such a way as to increase the quantity of air flow directed inside the container 16. Moreover, the container 16 has at least one inlet through hole 17*a* located nearer to the inlet opening 4 and at least one outlet through hole 17*b* located nearer to the outlet opening 5. Preferably, the inlet through hole 17*a* has a substantially transversal extension (angled) relative to the main direction of extension 3 and is at least partly facing the blowing means 6 in such a way as to receive the flow of air from the blowing means 6.

As already mentioned, the container 16 has a plurality of inlet through holes 17*a* located nearer to the inlet opening 4. Whilst, the outlet through hole 17*b* is located at the tip the nose-piece defined from the container 16.

Advantageously, the inlet through holes 17*a* and the outlet through hole 17*b* create a air current inside the container 16 for cooling the compression structure 13.

In that second embodiment, the air compression structure 13 is preferably located entirely inside the container 16.

In a third embodiment not illustrated in the accompanying drawings, the means for directing the air flow comprise both what shown in FIG. 1 and what shown in FIG. 2 as described above and here below incorporated in its entirety. In other words, in the third embodiment, the means of directing the air flow comprise the through opening 26 through which is inserted the protruding portion and at least one through hole 17 for the circulation of part of the air flow towards the inside of the container 16. Moreover, as mentioned above, the fluid delivery apparatus 11 comprises a duct 14 for carrying the compressed air from the air compression structure 13 to the delivery nozzle 12.

Advantageously, this duct 14 is at least partly located outside the tubular member 2 in such a way as to cool the compressed air present inside the tubular member 2. In other words, the duct 14 extends radially from the compression structure 13 towards the outside of the tubular member 2, and from the outside of the tubular member 2 towards the delivery nozzles 12.

Preferably as illustrated in the accompanying drawings, the duct 14 is at least partly located at the inlet opening 4 and it is, during use, struck by the flow of air entering the tubular member 2. More specifically, the duct 14 comprises a relative intermediate portion 18 located around the inlet opening 4 in such a way as to be struck by the inflow of air entering the tubular member 2. Preferably, the intermediate portion 18 has an upturned U-shape having two ends respectively connected to the compression structure 13 dispensing and to the delivery nozzles 12 by the duct 14. Moreover, the apparatus 11 for delivering the fluid comprises a discharge valve 20 located in communication with the duct 14 for discharging the condensate inside the duct 14. More specifically, the discharge valve 20 is located at a zone of the intermediate portion 18 closer to the ground 100. Preferably, the portion of conduit 14 which extends from the air compression structure 13 to the intermediate portion 18 is connected to the latter in a position close to the discharge valve 20.

In any case, the discharge valve 20 is preferably automatic and may comprise an internal heating device.

It should also be noted that the tubular member 2 is supported by an outer supporting structure 21 which rests on the ground 100.

Operation of this invention derives directly from what is described above. In particular, during use, the electric motor located inside the tubular member 2 moves both the compression structure 13 and the fan. In effect, the compression structure 13 and the fan are connected the rotary shaft 9 for receiving the movement from the electric motor.

Also, the container 16 defines an aerodynamic outer surface 23 for the sliding of the air flow protecting, at the same time, the compression structure 13 and the drive unit 7. In addition, the presence of the through openings 26 for the protruding portion 24 of the compression structure 13 or the presence of the through holes 17 for the entrance of air into the container 16 allow the compression structure 13 to be cooled, avoiding overheating of the latter. In effect, part of the air flow touches the compression structure 13 to prevent its overheating.

In this way, the invention achieves the set aims.

More specifically, the device for emitting a jet of fluid according to this invention optimises the electricity consumption. In effect, the device comprises a single motor for moving the compression structure and the fan. Simultaneously, thanks to the presence of the through openings and/or the through holes, there is a cooling of the compression structure in such a way as to avoid its excessive overheating and the negative repercussions on the temperature of the air flowing out from the snow cannon.

Moreover, the presence of the container favours the sliding of the flow of air inside the tubular member and contains part of the heat produced by the compression structure inside the cavity in such a way as to control the thermal disturbance on the flow of air.

It should also be noted that this invention is relatively easy to implement and that the cost of implementing the invention is relatively low.

The invention claimed is:

1. A fluid-jet emitting device (1), comprising:

a tubular member (2) having at least one air inlet opening (4) and one air outlet opening (5);

blowing means (6), located inside the tubular member (2) to suck air in through the inlet opening (4) and to produce an air flow out through the outlet opening (5); the blowing means (6) generating inside the tubular member (2) said air flow propagating from the inlet opening (4) to the outlet opening (5) and from the latter towards the outside environment; the blowing means (6) comprising a drive unit (7) and an air movement member (8) connected to the drive unit (7);

an apparatus (11) for delivering the fluid towards the air flow; the apparatus (11) comprising at least one fluid delivery nozzle (12) and an air compression structure (13) connected to the delivery nozzle (12) to mix the fluid with the compressed air;

the drive unit (7) being mechanically connected to the air compression structure (13) to set it in operation in such a way that the blowing means (6) and the air compression structure (13) are driven by the drive unit (7);

characterized in that the blowing means (6) comprise a container (16) defining an internal cavity (22) and located inside the tubular member (2); the container (16) having an outside surface (23) which is shaped to guide said air flow towards the outlet opening (5); at least part of the drive unit (7) and at least part of the compression structure (13) being located in the internal cavity (22) of the container (16); at least part of the compression structure (13) being directly exposed to the air flow produced by the blowing means (6) so as to cool the compression structure (13), characterized in that the compression structure (13) has a portion (24) which protrudes from the container (16) towards the inside of the tubular member (2) to be directly exposed to the air flow produced by the blowing means (6) so as to cool the compression structure (13), and characterized in that the compression structure comprises at least one head (25) internally defining a respective compression chamber where the air is compressed; at least part of the head (25) defining the protruding portion (24) of the compression structure (3).

2. The device according to claim 1, characterized in that the container (16) has at least one through hole (17) allowing circulation of part of the air flow towards the internal cavity (22) of the container (16) so that the compression structure (13) is exposed to the air flow produced by the blowing means (6) in order to cool the compression structure (13) during use.

3. The device (1) according to claim 2, characterized in that the container (16) has at least one inlet through hole (17*a*) located nearer than an outlet through hole (17*b*) to the inlet opening (4) and at least one outlet through hole (17*b*) located nearer than the inlet through hole (17*a*) to the outlet opening (5) so as to define an outlet for part of the air flow from the inlet through hole (17*a*) towards the internal cavity (22) of the container (16).

4. The device (1) according to claim 1, characterized in that the outside surface (23) has an outer shape which is at least partly tapered in a direction from the air inlet opening (4) to the air outlet opening (5), thus defining a diffuser between the outside surface (23) and the tubular member (2).

5. The device (1) according to claim 4, characterized in that the at least partly tapered outer shape is ogival.

6. The device (1) according to claim 1, characterized in that the apparatus for delivering fluid (11) comprises a duct (14) for carrying the compressed air from the compression structure (13) to the delivery nozzle (12); the duct (14) being at least partly located at the inlet opening (4) so as to promote cooling of the duct (14).

7. The device (1) according to claim 1, characterized in that the fluid delivery nozzle (12) is a nucleation nozzle.

8. A method for producing artificial snow, comprising: using the device (1) according to claim 1.

9. A fluid-jet emitting device (1), comprising:

a tubular member (2) having at least one air inlet opening (4) and one air outlet opening (5);

blowing means (6), located inside the tubular member (2) to suck air in through the inlet opening (4) and to produce an air flow out through the outlet opening (5); the blowing means (6) generating inside the tubular member (2) said air flow propagating from the inlet opening (4) to the outlet opening (5) and from the latter towards the outside environment; the blowing means (6) comprising a drive unit (7) and an air movement member (8) connected to the drive unit (7);

an apparatus (11) for delivering the fluid towards the air flow; the apparatus (11) comprising at least one fluid delivery nozzle (12) and an air compression structure (13) connected to the delivery nozzle (12) to mix the fluid with the compressed air;

the drive unit (7) being mechanically connected to the air compression structure (13) to set it in operation in such a way that the blowing means (6) and the air compression structure (13) are driven by the drive unit (7);

characterized in that the blowing means (6) comprise a container (16) defining an internal cavity (22) and located inside the tubular member (2); the container (16) having an outside surface (23) which is shaped to guide said air flow towards the outlet opening (5); at least part of the drive unit (7) and at least part of the compression structure (13) being located in the internal cavity (22) of the container (16); at least part of the compression structure (13) being directly exposed to the air flow produced by the blowing means (6) so as to cool the compression structure (13), characterized in that the container (16) has at least one through hole (17) allowing circulation of part of the air flow towards the internal cavity (22) of the container (16) so that the compression structure (13) is exposed to the air flow produced by the blowing means (6) in order to cool the compression structure (13) during use, and characterized in that the container (16) has at least one inlet through hole (17*a*) located nearer than an outlet through hole (17*b*) to the inlet opening (4) and at least one outlet through hole (17*b*) located nearer than the inlet through hole (17*a*) to the outlet opening (5) so as to define an outlet for part of the air flow from the inlet through hole (17*a*) towards the internal cavity (22) of the container (16).

10. The device (1) according to claim 9, characterized in that the compression structure (13) has a portion (24) which protrudes from the container (16) towards the inside of the tubular member (2) to be directly exposed to the air flow produced by the blowing means (6) so as to cool the compression structure (13).

11. The device (1) according to claim 9, characterized in that the compression structure (13) is located entirely inside the container (16).

12. The device (1) according to claim 9, characterized in that the outside surface (23) has an outer shape which is at least partly tapered in a direction from the air inlet opening (4) to the air outlet opening (5), thus defining a diffuser between the outside surface (23) and the tubular member (2).

13. The device (1) according to claim 12, characterized in that the at least partly tapered outer shape is ogival.

14. The device (1) according to claim 9, characterized in that the apparatus for delivering fluid (11) comprises a duct (14) for carrying the compressed air from the compression structure (13) to the delivery nozzle (12); the duct (14) being at least partly located at the inlet opening (4) so as to promote cooling of the duct (14).

15. The device (1) according to claim 9, characterized in that the fluid delivery nozzle (12) is a nucleation nozzle.

16. A method for producing artificial snow, comprising: using the device (1) according to claim 9.

* * * * *